United States Patent [19]

Schrunk

[11] Patent Number: 4,761,931

[45] Date of Patent: Aug. 9, 1988

[54] STAINED GLASS TABLE FRAME

[76] Inventor: Thomas R. Schrunk, 2025 19th Ave. N.E., Minneapolis, Minn. 55413

[21] Appl. No.: 84

[22] Filed: Jan. 2, 1987

[51] Int. Cl.[4] ..... E04C 2/24

[52] U.S. Cl. ..... 52/788; 52/823; 108/11; 108/161; 312/140.1

[58] Field of Search ..... 312/140.1, 140.2, 140.3; 52/788, 3 VX, 316, 306, 823, 815, 817, 818; 273/309; 108/11, 161

[56] References Cited

U.S. PATENT DOCUMENTS

| | | | |
|---|---|---|---|
| 1,644,289 | 10/1927 | Timpson | 312/140.3 |
| 1,899,366 | 2/1933 | Threefoot | 273/309 |
| 1,900,513 | 3/1933 | Marsh | 273/209 |
| 3,190,411 | 6/1965 | Pasche | 49/401 |
| 3,212,952 | 10/1965 | Turner | 108/161 |
| 3,226,903 | 1/1966 | Lillethun | 52/311 |
| 3,460,303 | 8/1969 | Algrain et al. | 52/308 |
| 4,223,499 | 9/1980 | Schrunk | 52/308 |

*Primary Examiner*—James L. Ridgill, Jr.
*Attorney, Agent, or Firm*—Clayton R. Johnson

[57] ABSTRACT

A table having a table top frame that has a central opening which is in part defined by an inner peripheral rib for supporting a horizontal tempered protective glass pane with its top surface coplanar with the table top, and an inner peripheral lip for supporting a tempered protective glass pane which in turn supports a decorative glass unit. The minimum dimension of the spacing of the horizontally opposite, adjacent edges of the rib is substantially less than the corresponding spacing of the horizontally opposite, adjacent edges of the lip, the rib extending between the top glass pane and the decorative glass unit. The minimum dimension of horizontally opposite, adjacent parts of the outer peripheral frame of the decorative glass unit is substantially greater than the above mentioned minimum dimension of the rib whereby the unit outer peripheral frame is at least substantially concealed when viewed from above the top protective glass pane.

11 Claims, 1 Drawing Sheet

FIG. 2
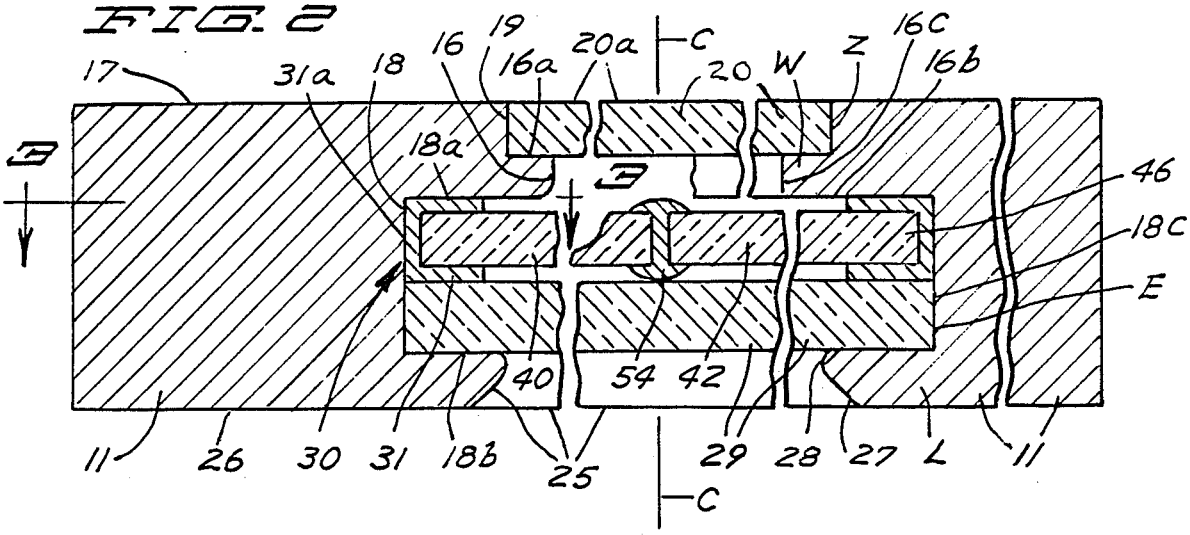
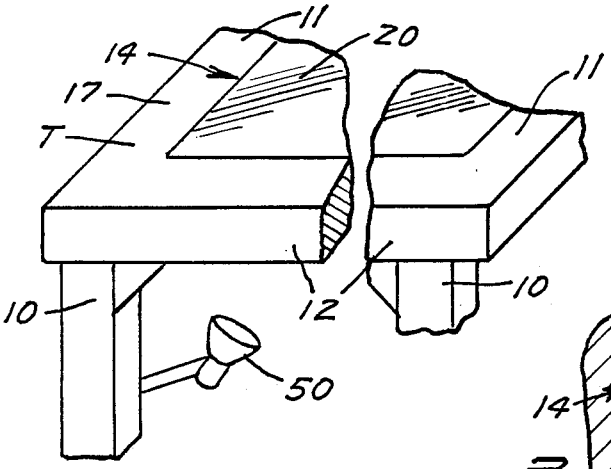
FIG. 1
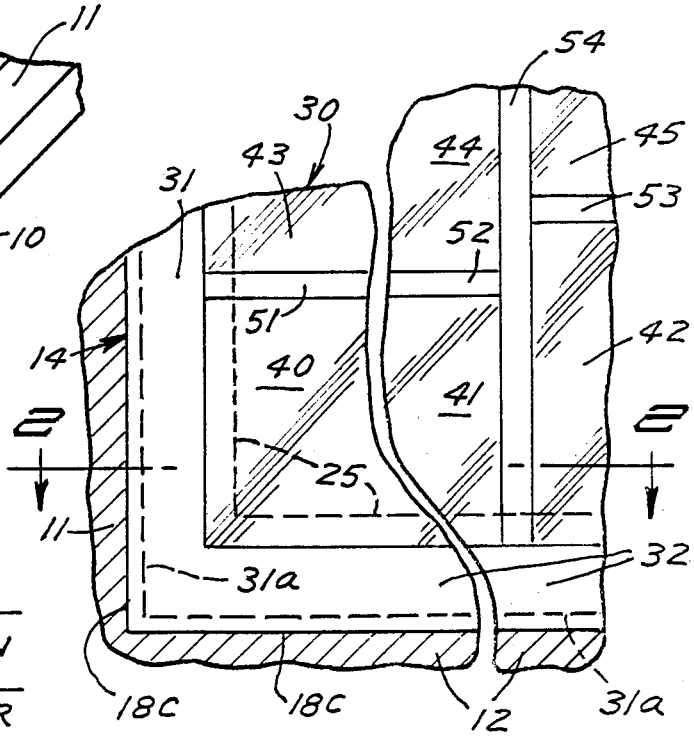
FIG. 3
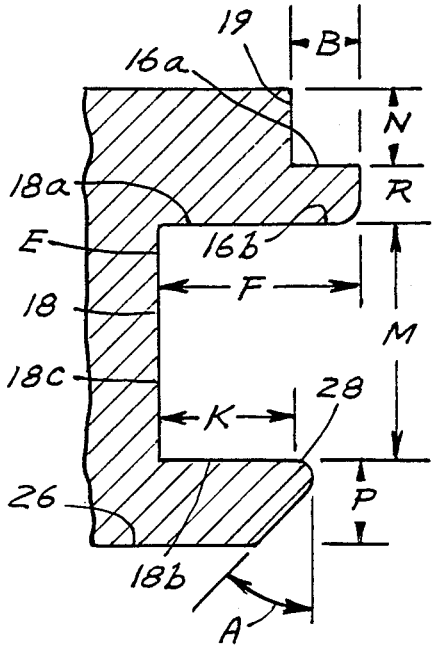
FIG. 4

STAINED GLASS TABLE FRAME

BACKGROUND OF THE INVENTION

There is disclosed a frame for mounting a decorative glass unit.

In my U.S. Pat. No. 4,223,499 there is disclosed a decorative stained glass unit that includes a peripheral frame surrounding panes of stained glass and is attached to an existing window frame by, for example, screws. Each of U.S. Pat. Nos. 3,190,411 and 3,226,903 disclose frame structure for mounting stained glass panes, the stained glass panes being located between outer smoothed glass panes in U.S. Pat. No. 3,226,903.

In order to provide a new and novel table frame that is adapted for mounting stained glass units, this invention has been made.

SUMMARY OF THE INVENTION

A table top frame adapted for mounting a stained glass unit and a protective glass pane includes a central opening, which has a central vertical axis, and a top surface, the central opening at least in part being defined by an inner peripheral rib at a lower elevation than the top surface for supporting a protective glass pane and an inner peripheral lip at a lower elevation than the rib for supporting at least one of a glass pane and a stained glass unit. The minimum dimensions through the central axis and horizontally opposite parts of the peripheral rib is substantially less than the corresponding minimum dimension of the horizontally opposite parts of the peripheral lip.

One of the objects of this invention is to provide a new and novel table frame for mounting a stained glass unit and a protective glass unit in vertical spaced relationship to and above the stained glass unit. Another object of this invention is to provide a new and novel table top frame for mounting a transparent protective glass pane and one or more vertically stacked, horizontal glass units vertically below and spaced from the protective glass pane and blocking the viewing of the perimetric edge portions of such units from directly vertically above the frame.

BRIEF DESCRIPTION OF THE DRAWINGS

FIG. 1 is a fragmentary perspective view of a table that incorporates the present invention, an intermediate part being broken away;

FIG. 2 is a vertical cross sectional view generally taken along the line and in the direction of the arrows 2—2 of FIG. 3;

FIG. 3 is a fragmentary horizontal cross sectional view generally taken along the line and in the direction of the arrows 3—3 of FIG. 2; and FIG. 4 is a fragmentary, vertical cross sectional view of the table frame of this invention.

Referring to the drawings the table includes a table top T of this invention that is mounted on depending legs 10 and has horizontally opposite side frame members 11 and end frame members 12. The frame members are suitably joined together to provide a rectangular table top frame enclosing a central opening, generally designated 14. Even though, to a considerable extent, each of the various parts of the frame members defining the central opening will be described as if they are separate distinct elements, as will subsequently become apparent, the respective separate elements of each frame member form a part of inner peripheral portion of the table top frame.

Each frame member includes a horizontal rib 16 that is at a lower elevation than the top surface 17 and extends inwardly toward the corresponding rib of the opposite frame member. The ribs 16 have top surfaces **16*a* and adjacent vertical edges 16*c*. The minimum horizontal spacing of opposite edges 16*c* is less than the corresponding spacing of the vertical edges 19 that in part define opening 14 and extend vertically from surface 16*a* to the top surface 17. The edges 19 of opposite frame members are parallel to one another. A tempered, protective glass pane 20, preferrably transparent, is supported by rib surfaces 16*a* and preferrably is of a size to substantially fill the part of the opening 14 that is defined by edges 19. It is preferred that the top surface 20*a* of pane 20 is coplanar with the table frame top surface 17**.

The central opening also in part is defined by a groove 18 in each frame member that opens toward a corresponding groove in the opposite frame member. The grooves are defined by top horizontal surfaces **18*a* that are coplanar with rib surfaces 16*b*, the surfaces 18*a*, 16*b* of each frame member being coextensive with the other and providing the groove top surfaces. Each groove 18 is also in part defined by the respective frame member vertical edge 18*c* and bottom horizontal surface 18*b*. The edges 18*c* of opposite frame members are of substantial greater minimum horizontal spacing than the corresponding spacing of the edges 19 of the same frame members while the vertical spacing of surfaces 18*a* from surfaces 18*b* is preferrably substantially greater than the spacing of surfaces 18*a* (16*b*) from the table top surface. Additionally the minimum spacing of horizontally opposite edges 16*c* is substantially less than the corresponding spacing of edges 19** of the same frame members.

The lower part of the table opening is defined by a lower lip 25 on each frame member that projects inwardly toward the corresponding lip on the horizontally opposite frame member. Each lip is in part defined by surface **18*b*, the table top lower surface 26, a beveled edge 27 that is tapered downwardly in a direction away from the horizontally opposite edge and a top arcuately curved edge 28 that joins the beveled edge to support surface 18*b*. Surfaces 18*b* are coplanar and support a glass pane 29. The length and width dimensions of pane 29 preferrably are only slightly less than the corresponding spacing of the respective pair of horizontally opposite edges 18*c* and the thickness of the pane being advantageously substantially less than the vertical dimension of edges 18*c*. Surfaces 18*b*, 18*a*, 16*b*, 16*a*** are parallel to one another.

A decorative glass unit, generally designated 30, includes horizontally opposite, metal side channels 31 and end channels 32 that are joined to provide an open rectangular unit frame with opposite channel grooves opening toward one another. The maximum horizontal length and width dimensions of the channel frame are advantageously substantially the same as the corresponding dimensions of the glass pane 29. The glazing section of unit 30 usually comprises two or more quarries or panes of stained (tinted) glass of different colors, or provide different decorative effects, the panes of stained glass shown being designated 41 through 46 respectively. The panes 40–42 and 46 and other outer peripheral panes (not shown) edge portions extend into the adjacent channel grooves while generally H-shaped cames 51–54 have the remaining edge portions extended into came section grooves in a conventional manner. Preferrably the came sections and channel frame are of a size and shape that while abutting against the top surface of pane 29, the stain glass panes will be parallel to pane 29. The support pane 29 is provided to prevent sagging of the stained glass panes.

The pane 20 is supported to be vertically spaced from the glass unit 30 so that if it should flex a little from having something dropped on it, the shock would not be transmitted to unit 30. Further the grooves 18 are of depths and the channels 31, 32 are of widths such that a party in normally looking down through pane 20 would not see the channels. Additionally the dimension K of each lip is preferrably greater than the corresponding dimension of the horizontal legs of the respective unit channel. With the width of the surface **18*b* of each table top frame member being shorter than the combinded width of surfaces 16*b*, 18*a* (dimension F) there is obtained a greater viewing angle from above, the lip 25** is stronger in that it has a reduced moment arm, and the table top frame members are easier to mill and ship.

Due to the tinting of the stained glass panes and the horizontal spacing of horizontally opposite legs of the channels being greater than the edges **16*c* of opposite ribs, the glass unit 30 appears to be of a larger size (length and width) than its actual size. Additionally with edges 27, 28 being beveled and rounded, and with an electric light 50, which may be mounted on a table leg beneath the opening 14**, directed upwardly, a better angle is obtained for under frame illumination, if used.

With the table top frame members joined together to form a rectangular table top, each set of edges **19, 16*c* and 18*c* respectively form a peripheral edge. Similarly each set of surfaces 16*a*, 18*b*, and 18*a* and 16*b* (in combination) respectively form a rectangular peripheral surface. Thus there is provided an inner peripheral rib, peripheral lip and peripheral groove. Such peripheral edges and surfaces could be of other shapes if the opening 14 is other than rectangular as in part will be indicated below. Accordingly the peripheral dimension of the peripheral rib 6 (ribs 16 of the frame members) is less than the minimum peripheral dimension of the peripheral lip (lips 29 of the frame members) and the maximum peripheral dimension of the groove E (grooves 18 of the frame members) which in turn is substantially larger than the minimum dimension of the peripheral lip. Additionally the peripheral dimension of the peripheral edge Z (edges 19**) is greater than the minimum peripheral dimension of the rib W but smaller than the maximum peripheral dimension of the groove E.

Even though in FIG. 1 or FIG. 3 there is no showing of lines defining the opposite ends of frame members 11, 12, it is to be understood that, for example, the opposite end portions may be miter cut and suitably joined to one another. Also it is to be understood that the table instead of being rectangular, it may be oval or circular. If the table top is circular, the table top may be made in two semi-circular sections and suitably joined together whereby each of edges **16*c*, 18*c* 19 as viewed in FIG. 4 would be cylindrical, surfaces 16*a*, 16*b*, 18*a*, 18*b* annular, and surface 27 frusto conical. FIG. 4 would be a fragmentary vertical, radial cross sectional view of a semi-circular section of a table top wherein the plane of cross section passes through the opening central vertical axis C—C of the table frame central opening. That is wherein the relative dimension between opposite table top frame members referred to in describing a rectangular top would be relative diameters of a circular table top. Additionally even though opening 14 has been referred to as a central opening it is to be understood opening 14 does not have to be centered in the table top, nor that the horizontal width of frame members 31, 32** has to be the same, nor that the opening has to be symetrical relative to axis C—C. The table top frame members may be made of wood, metal or plastic.

In place of the glass unit 30 and pane 29 being supported by lips 25, there may be one pane of substantially a thickness M (height of groove 18), or three panes that may be of different thickness but of a combined thickness M, or spacers may be provided in the peripheral grooves 18 if the combined thickness of pane 29 and unit 30 is less than dimension M, if desired. Also if the dimension N of edges 19 is greater than the thickness of the protective pane 20, spacers (not shown) may be provided on surfaces **16*a* so that the top surface of pane 20 is substantially coplanar with the remainder of the surface 17** of the table top.

As an example of one embodiment of the invention, but not otherwise as a limitation thereon, dimensions N, R, M, P may be respectively 3/16", ¼", 17/32", 3/16" while dimensions B, F, K may be respectively 3/16, ½", ⅜", and the angle of taper of surface 27 may be of an angle X of about 10°–30°. With reference to the specific dimensions set forth are as follows: N the height of a frame member edge 19, R the height ot edge **16*c*, M the height of groove E, P the thickness of lip 25 (spacing of surface 18*b* from the table bottom surface 26), T the width of rib supporting surface 16*a*, F the combined width of surfaces 18*a*, 16*b* and K the width of horizontal surface 18*b***.

What is claimed is:

1. For mounting a top protective glass pane and at least one of a decorative glass unit and a glass pane vertically below and spaced from the protective glass, comprising a table frame having a central opening which has a central vertical axis and a top horizontal surface, the central opening at least in part being defined by a horizontal, inner peripheral rib, an inner peripheral lip, and a vertical peripheral first edge vertically between the rib and lip, the inner peripheral lip being at a substantial lower elevation than the top surface and being adapted for supporting a top protective glass pane and the horizontal, inner peripheral lip being at a substantial distance below the rib and adapted for supporting at least one of a decorative glass unit and a glass pane in vertical spaced relationship to a protective glass pane supported on the rib, the minimum peripheral dimension of the rib being substantially less than the minimum peripheral dimension of the lip, and the rib, lip and peripheral vertical frame edge at least in part defining a peripheral groove that forms a part of the central opening, and has a maximum peripheral dimension that is substantially greater than the minimum peripheral dimension of the lip.

2. The stucture of claim 1 further characterized in that the central opening at least in part is defined by a second, inner peripheral edge that extends between the rib and table top surface, the peripheral dimension of the above edge being substantially greater than the above mentioned rib dimension.

3. The structure of claim 2 further characterized in that the peripheral dimension of the second edge is substantially less than the peripheral dimension of the first edge.

4. The structure of claim 2 further characterized in that the vertical dimension of the first edge is substantially greater than the corresponding dimension of the second edge, and that the horizontal dimension of the rib in a direction from the second edge toward the central axis is substantially less than the corresponding horizonatal dimension of the lip from the first edge toward the central axis.

5. A table top mounted on table legs and comprising a peripheral frame surrounding an opening having a central vertical axis and a horizontal table top, the table top frame including horizontally opposite frame sections on opposite sides of the central axis, the frame sections including horizontally opposite inner rib and lip portions that are vertically spaced from one another, the rib portions being vertically spaced from the table top surface and vertically between the table surface and the lip portions and vertically opposite edge portions extending between the rib and lip portions, the minimum dimension between the rib portions on opposite sides of the central axis being substantially less than the corresponding dimension of said edge portions, a horizontal protective first glass pane abutting against said rib portions to in part be supported thereby, and one of a decorative glass unit and a second glass pane abutting against said lip portions to in part be supported by said lip portions and of a dimension that corresponds to the above mentioned dimension of the rib portion that is substantially greater than the last mentioned dimension, the rib and lip portions in part defining the central opening.

6. The table top of claim 5 further characterized in that the dimension of the top glass pane that corresponds to the first mentioned dimension of spacing of the rib portions is substantially less than the above menitioned dimension of the one of the glass unit and the second glass pane.

7. The table top of claim 6 further characterized in that the vertical dimension of each of the edge portions is substantially less than the thickness of the top glass pane and that the top glass pane has a top surface that is substantially coplanar with the frame top surface.

8. The table top of claim 6 further characterized in that the one of the decorative glass unit and the second glass pane comprises a second glass pane that in part is supported by said lip portions and that there is provided a decorative glass unit that includes at least one decorative glass pane and a perimetric border frame that is supported by the second glass pane, said border frame including opposite border frame portions that are above said lip portions and of a minimum spacing that is greater than the corresponding spacing of said rib portions and being vertically spaced from the top glass pane.

9. The table top of claim 8 characterized in that each frame section has a groove that opens toward the groove of the other frame section, the rib and lip portions having horizontal bottom and top surfaces respectively that together with said edges at least in part define said grooves, the grooves being defined by wall means providing top groove surfaces that includes the rib bottom surfaces, and that in vertical cross section through one of the frame sections and the central axis, the dimension of the groove top surface is substantially greater than the corresponding dimension of the lip portions top surfaces.

10. The table top of claim 9 further characterized in that each lip portion includes a horizontal bottom surface and a beveled edge that is tapered upwardly in a direction toward the opposite frame section, and that the horizontally oppoisite frame sections each has a second edge extending between the table top surface and the respective rib, the horizontal dimension between the second edges of the horizontally opposite frame members being only slightly greater than the corresponding dimension of the first glass pane, substantially greater than said minimum dimension between the rib portions and substantially less than the said corresponding dimension of said edge portions.

11. The table top of claim 9 further characterized in that the decorative glass unit includes a generally H-shaped came and a second decorative glass pane, the first and second decorative panes having adjacent edges extended into the came, the came being in abutting supported relationship to the first mentioned second glass pane and vertically spaced from the top glass pane.

* * * * *